US006061546A

United States Patent [19]

Sawamura et al.

[11] Patent Number: 6,061,546

[45] Date of Patent: May 9, 2000

[54] CLEANING APPARATUS AND IMAGE FORMATION APPARATUS

[75] Inventors: Jun Sawamura; Ryouichi Tsuruoka, both of Iwatsuki; Satoshi Matsuzaka, Ebina, all of Japan

[73] Assignee: Fuji Xerox Co., Ltd., Tokyo, Japan

[21] Appl. No.: 09/273,499

[22] Filed: Mar. 22, 1999

[30] Foreign Application Priority Data

Apr. 9, 1998 [JP] Japan ..... 10-097674

[51] Int. Cl.[7] ..... G03G 21/10

[52] U.S. Cl. ..... 399/358; 399/123

[58] Field of Search ..... 399/343, 345, 399/358, 360, 123

[56] References Cited

U.S. PATENT DOCUMENTS 3,917,398 11/1975 Takahashi et al. ..... 399/358 X
4,218,131 8/1980 Ito et al. ..... 399/358 X
4,218,132 8/1980 Iwai et al. ..... 399/358
4,297,026 10/1981 Honda et al. ..... 399/123
4,357,098 11/1982 Endo ..... 399/123
5,617,194 4/1997 Morishita et al. ..... 399/358 X

FOREIGN PATENT DOCUMENTS 9-292820 11/1997 Japan .

*Primary Examiner*—Sandra Brase
*Attorney, Agent, or Firm*—Oliff & Berridge, PLC

[57] ABSTRACT

In a cleaning apparatus, a film as a guide plate for guiding cleaned toner into the apparatus is bonded to a holder, which is screwed to a housing. The screwing is loosened by a predetermined amount for providing a gap between the holder and the housing. If the housing and the seal member are thermally expanded by heat from a fuser during the operation of a image formation apparatus and a difference occurs between the expansion amounts of the housing and the holder, the gap absorbs the expansion amount difference and a force of warp, distortion, etc., does not act on the holder. Therefor, deformation of the film held by the holder can be prevented and trouble such as toner not being guided into the apparatus and scatters can be prevented.

6 Claims, 9 Drawing Sheets

FIG. 7

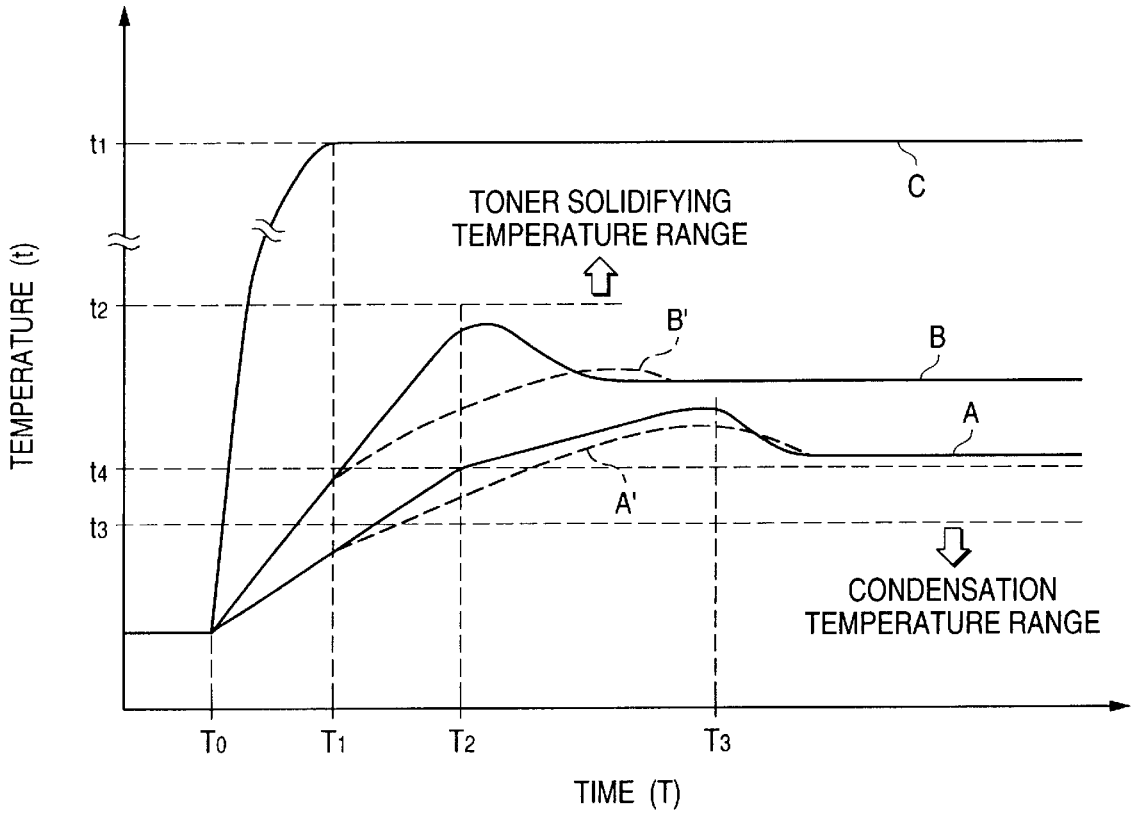

A: TEMPERATURE OF PHOTOSENSITIVE DRUM 12
B: TEMPERATURE OF CLEANING APPARATUS 26
C: THERMAL FUSER TEMPERATURE
$t_1$: SETUP TEMPERATURE OF THERMAL FUSER
$t_2$: TONER SOLIDIFYING BOUNDARY TEMPERATURE
$t_3$: CONDENSATION BOUNDARY TEMPERATURE
$t_4$: OUTSIDE AIR TEMPERATURE
$T_0$: POWER ON TIME
$T_1$: TIME AT WHICH THERMAL FUSER TEMPERATURE C REACHES $T_1$
$T_2$: DRIVE START TIME OF COOLING FAN 30
$T_3$: DRIVE START TIME OF COOLING FAN 32
A': TEMPERATURE OF PHOTOSENSITIVE DRUM 12 IF DRIVE OF COOLING FAN 30 IS STARTED AT TIME $T_1$
B': INTERNAL TEMPERATURE OF CLEANING APPARATUS 26 IF DRIVE OF COOLING FAN 30 IS STARTED AT TIME $T_1$

FIG. 8

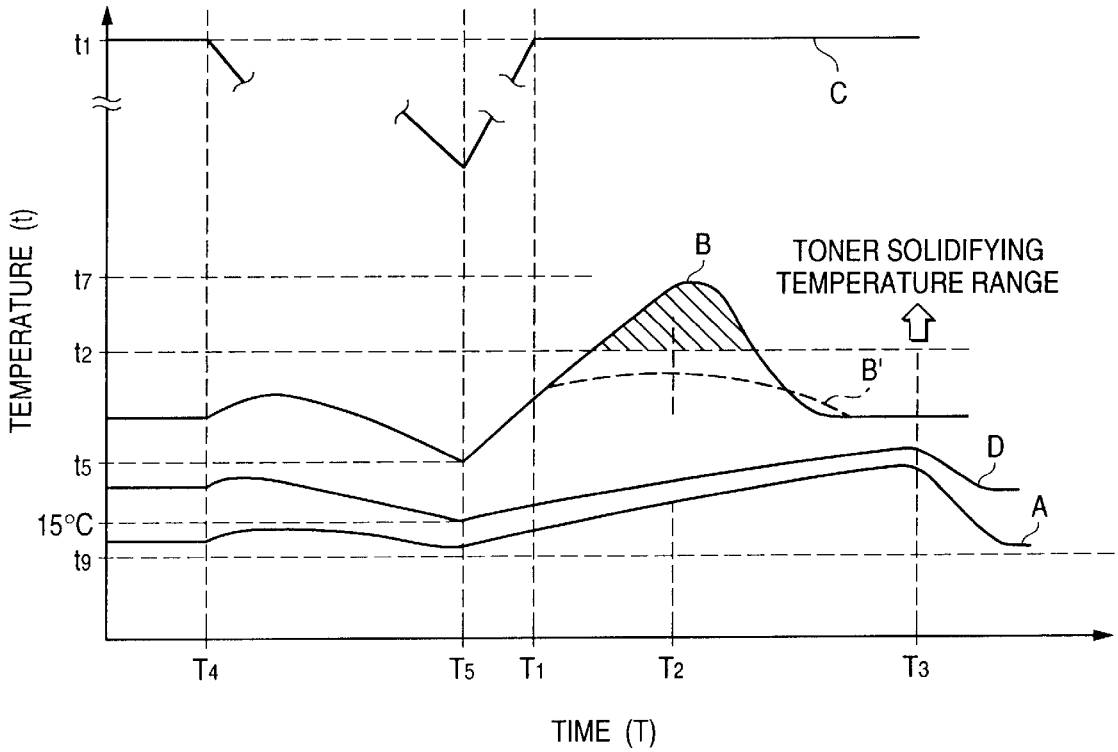

A ~ C, $T_1$ ~ $T_3$, $t_1$ AND $t_2$: SAME AS THOSE IN FIG. 7
D: INTRA-MACHINE TEMPERATURE
$T_4$: POWER OFF TIME
$T_5$: TIME AT WHICH POWER IS AGAIN TURNED ON
$t_5$: TEMPERATURE OF CLEANING APPARATUS 26 WHEN POWER IS AGAIN TURNED ON
$t_7$: TEMPERATURE OF THERMAL FUSER 28 WHEN TEMPERATURE OF CLEANING APPARATUS 26 BECOMES STABLE AFTER POWER IS TURNED OFF
$t_9$: INTRA-MACHINE TEMPERATURE IN STABLE STATE AFTER POWER IS TURNED OFF

A ~ D, $T_4$, $t_1$, $t_2$ AND $t_9$: SAME AS THOSE IN FIG. 7, 8
$T_7$: TIME UNTIL TEMPERATURE OF CLEANING APPARATUS 26 BECOMES STABLE AFTER POWER IS TURNED OFF
$t_7$: TEMPERATURE OF THERMAL FUSER 28 WHEN TEMPERATURE OF CLEANING APPARATUS 26 BECOMES STABLE AFTER POWER IS TURNED OFF

CLEANING APPARATUS AND IMAGE FORMATION APPARATUS

BACKGROUND OF THE INVENTION

This invention relates to a cleaning apparatus and an image formation apparatus and more particularly to a cleaning apparatus placed in the proximity of a surface of an image support with a toner image formed on the surface and an image formation apparatus for transferring the toner image formed on the image support to a recording medium and executing thermal fixing for the recording medium onto which the toner image is transferred by a thermal fuser for forming an image on the recording medium.

Generally, in an image formation apparatus using electrophotography, a cleaning apparatus for cleaning residual toner on an image support is installed in the proximity of the image support. As the cleaning apparatus, a cleaning apparatus of an integral type comprising a cleaning member for cleaning residual toner on an image support, a housing formed with an opening toward the image support, and a seal member being held on the housing for guiding the cleaned toner into the housing in one piece is widely used from the advantages of costs, productivity, maintenance, etc. It is required that the cleaning member and the seal member be positioned with respect to the image support with high accuracy; the integral-type cleaning apparatus is also advantageous from the viewpoints of high-accuracy design and accuracy control.

Particularly in a color image formation apparatus springing into wide use in recent years, generally it is necessary to overlay color toners of yellow, magenta, cyan, and black on each other. For example, in an image formation apparatus using an intermediate transfer body, the four colors are overlaid on the intermediate transfer body. At this time, a cleaning apparatus must be out of contact with the intermediate transfer body. After four color toner images are transferred to a recording medium, such as paper, in batch, the cleaning apparatus abuts the intermediate transfer body for cleaning residual toner.

Thus, the cleaning apparatus of the color image formation apparatus needs to be brought into contact with or out of contact with the intermediate transfer body, and becomes inferior to a fixed cleaning apparatus of a single-color image formation apparatus in position accuracy relative to the cleaned surface. Then, to compensate for degradation of position accuracy, higher accuracy is required for the cleaning apparatus itself, namely, the dimensions, etc., of a cleaning member and a seal member.

However, in a high-density image formation apparatus such as a recent color laser beam printer, often a cleaning apparatus must be installed at a position near a thermal fuser. In this case, the cleaning apparatus is heated and is thermally expanded by heat-generated from the thermal fuser.

Particularly, a housing of a cleaning apparatus usually is formed of a plastic resin and has a large expansion amount. If such a housing differs from a cleaning member and a seal member in thermal expansion coefficient, a force occurs in the retention portions of the cleaning member and the seal member in the housing and warps or distorts the cleaning member and the seal member. Thus, it is feared that a problem of a cleaning failure or toner scattering may arise. Particularly, the seal member usually is formed of urethane, polyethylene terephthalate, etc., like a film; it is feared that shape change such as warp or distortion may be caused if a slight force occurs in the retention portion of the seal member.

As trouble caused by heat from a thermal fuser, toner in a cleaning apparatus near the thermal fuser is solidified. To prevent toner from being solidified, generally a fan for releasing heat generated from the thermal fuser into the outside and cooling the thermal fuser and its peripheral devices is installed aside from a fan for cooling an optical scanner, a photosensitive body, a developing apparatus, etc.

Hitherto, just after power of the image formation apparatus is turned on or when the thermal fuser reaches a preset fixing temperature, the two fans start to turn and cool the thermal fuser, the optical scanner, the photosensitive body, the developing apparatus, etc.

In the above-described control, however, if the image formation apparatus is installed in poor temperature and humidity environments, condensation may occur on the photosensitive body, etc. If the two fans start to cool the components in the condensation occurrence state, temperature in the image formation apparatus does not much arise and it is feared that image formation processing may be started with condensation left. In this case, print image quality is degraded and it is feared that a current may leak through water drops, causing trouble such as breakage of the image formation apparatus.

To cope with such condensation occurrence, the Unexamined Japanese Patent Application Publication No. Hei 9-292820 discloses an art for preventing condensation by stopping fans until the inside of a apparatus is warmed after power is turned on.

However, if the fans remain stopped, the periphery of a thermal fuser reaches a high temperature and a problem of solidifying toner in a cleaning apparatus again arises.

SUMMARY OF THE INVENTION

It is therefore an object of the invention to provide a cleaning apparatus and an image formation apparatus that can prevent trouble such as deformation of a seal member and solidification of toner caused by heat generated from a thermal fuser, etc.

According to the invention 1, there is provided a cleaning apparatus being placed in the proximity of a surface of an image support with a toner image formed on the surface, the cleaning apparatus comprising: a cleaning member for cleaning residual toner on the image support; a housing having an opening formed toward the image support; and a holding plate being installed so as to be able to make a relative move to the housing in a predetermined range for holding a seal member for guiding toner cleaned by the cleaning member into the housing.

According to the invention 2, there is provided a cleaning apparatus being placed in the proximity of a surface of an image support with a toner image formed on the surface, the cleaning apparatus comprising a cleaning member for cleaning residual toner on the image support, a housing having an opening formed toward the image support, and a holding plate being formed of a material different from the housing in thermal expansion coefficient and installed so as to be able to make a relative move to the housing in a predetermined range for holding a seal member for guiding toner cleaned by the cleaning member into the housing.

In accordance with another aspect of the invention, the holding plate is spaced from the housing with a predetermined gap.

In accordance with another aspect of the invention, the holding plate is held on the housing by the urging force of an elastic member.

In accordance with another aspect of invention, the holding plate is held on the housing with an elastic member between.

In accordance with another aspect of the invention, the holding plate is held on the housing and is formed with a low-rigidity part on the periphery of the holding part.

In accordance with another aspect of the invention, there is provided an image formation apparatus for transferring a toner image formed on an image support to a recording medium and executing thermal fixing for the recording medium onto which the toner image is transferred by a thermal fuser for forming an image on the recording medium and allowing heat generated from the thermal fuser to propagate to the installation space of the image support, the image formation apparatus comprising a first fan for releasing heat generated from the thermal fuser into the outside, a second fan for releasing heat on the periphery of the image support into the outside; and drive control means for driving the first fan after the expiration of a first predetermined time since power was turned on and later driving the second fan when a second predetermined time has elapsed or when the first image formation operation is started.

In accordance with another aspect of the invention, the first predetermined time is set longer than the time for which the temperature of the thermal fuser rises to the setup temperature of fixing processing.

The further includes an intra-apparatus temperature sensor for detecting intra-apparatus temperature in the image formation apparatus and inhibition means for inhibiting drive control of the drive control means if the intra-apparatus temperature detected by the intra-apparatus temperature sensor is higher than a predetermined temperature.

The image formation apparatus further includes an intra-apparatus temperature sensor for detecting intra-apparatus temperature in the image formation apparatus, a thermal fuser temperature sensor for detecting temperature of the thermal fuser, and inhibition means for inhibiting drive control of the drive control means if the intra-apparatus temperature detected by the intra-apparatus temperature sensor is higher than a first predetermined temperature and the temperature of the thermal fuser detected by the thermal fuser temperature sensor is higher than a second predetermined temperature.

The cleaning apparatus is placed in the proximity of the surface of the image support (for example, a photosensitive drum, a photosensitive belt, an intermediate transfer belt, or the like) with a toner image formed on the surface, and has the housing having an opening formed toward the image support. With the cleaning apparatus, residual toner on the image support is cleaned by the cleaning member and the cleaned toner is guided into the housing by the seal member. The residual toner on the image support is thus removed from the image support surface and is stored in the housing.

In the cleaning apparatus, the seal member is held on the holding plate, which is formed of a material different from the housing in thermal expansion coefficient. Therefore, if the housing and the holding plate are thermally expanded by heat generated from the thermal fuser, etc., a difference occurs between the terminal expansion amounts of the housing and the holding plate.

However, the holding plate is installed so as to be able to make a relative move to the housing in a predetermined range. Thus, if a terminal expansion amount difference occurs between the housing and the holding plate as mentioned above, the holding plate makes a relative move to the housing in response to the terminal expansion amount difference, whereby a situation in which warp, distortion, etc., occurs on the holding plate and the seal member held on the holding plate becomes deformed can be prevented.

Thus, according to the invention, the holding plate makes a relative move to the housing in response to the terminal expansion amount difference, thus warp or distortion of the holding plate and deformation of the seal member can be prevented and trouble such that the toner cleaned by the cleaning member is not guided into the housing and scatters can be prevented.

To install the holding plate so that it can make a relative move to the housing within a predetermined range as mentioned above, the holding plate may be spaced from the housing with a predetermined gap. In this case, if a terminal expansion amount difference occurs between the housing and the holding plate, the gap absorbs the terminal expansion amount difference, so that a situation in which warp, distortion, etc., occurs on the holding plate and the seal member held on the holding plate becomes deformed can be prevented.

The holding plate may be held on the housing by the urging force of an elastic member. In this case, if a terminal expansion amount difference occurs between the housing and the holding plate, it is absorbed because of elastic deformation of the elastic member, so that a situation in which warp, distortion, etc., occurs on the holding plate and the seal member held on the holding plate becomes deformed can be prevented.

The holding plate may be held on the housing with an elastic member between. Also in this case, if a terminal expansion amount difference occurs between the housing and the holding plate, it is absorbed because of elastic deformation of the elastic member, so that a situation in which warp, distortion, etc., occurs on the holding plate and the seal member held on the holding plate becomes deformed can be prevented.

The holding plate may be formed with a low-rigidity part on the periphery of the holding part where it is held on the housing. Also in this case, if a terminal expansion amount difference occurs between the housing and the holding plate, it is absorbed because of deformation of the low-rigidity part, so that a situation in which warp, distortion, etc., occurs on the holding plate and the seal member held on the holding plate becomes deformed can be prevented.

In the image formation apparatus a toner image formed on the image support is transferred to a recording medium (for example, recording paper, an OHP sheet, etc.,) and thermal fixing is executed for the recording medium onto which the toner image is transferred by the thermal fuser, thereby forming an image on the recording medium. Heat generated from the thermal fuser can propagate to the installation space of the image support. That is, the thermal fuser and the image support are housed in the same room or although they are housed in separate rooms, a gap exists between the rooms to such a degree that heat propagates.

The image formation apparatus is provided with the first fan for releasing heat generated from the thermal fuser into the outside and the second fan for releasing heat on the periphery of the image support into the outside. The drive control means drives only the first fan after the expiration of the first predetermined time since power was turned on.

Thus, the first and second fans stop just after the power is turned on, so that heat generated from the thermal fuser and heat on the periphery of the image support are not released into the outside of the image formation apparatus. Therefore, the temperature in the apparatus rises quickly; it can be made to rise in a short time to the temperature at which no condensation occurs on the image support, etc. That is, the heat generated from the thermal fuser can be effectively used to make the temperature in the apparatus rise in a short time to the temperature at which no condensation occurs on the image support, etc. Since outside air is prevented from entering the periphery of the image support, the image formation apparatus is set to a state in which condensation is hard to occur.

Only the first fan is driven after the expiration of the first predetermined time since the power was turned on and the heat from the thermal fuser is released into the outside of the image formation apparatus, whereby a temperature rise on the periphery of the thermal fuser is weakened, a situation in which the temperature on the periphery of the thermal fuser rises to the toner solidifying temperature or more is avoided, and toner can be prevented from being solidified in the components on the periphery of the thermal fuser.

When the second predetermined time has elapsed since the first fan was driven or when the first image formation operation is started, the drive means drives the second fan. A time lag is thus provided between the drive start of the first fan and that of the second fan, whereby when only the first fan is driven, the temperature in the apparatus is made to moderately rise by heat from the components on the periphery of the image support, and at least a situation in which the temperature in the apparatus falls below the temperature at which condensation occurs can be avoided.

After the second fan is driven, the heat in the apparatus is released by the first and second fans, so that the temperature in the apparatus is kept at the temperature at which condensation occurs or higher and the toner solidifying temperature or higher.

Thus, while a situation in which the temperature on the periphery of the thermal fuser rises to the toner solidifying temperature or more is avoided, the heat generated from the thermal fuser can be effectively used to make the temperature in the apparatus rise in a short time to the temperature at which no condensation occurs on the image support, etc.

The first predetermined time (drive start time of the first fan) may be set longer than the time for which the temperature of the thermal fuser rises to the setup temperature of fixing processing. That is, generally as shown in FIG. 7, when the thermal fuser temperature C reaches the fixing processing setup temperature t1 (at time T1), temperature B of the component on the periphery of the thermal fuser, such of the cleaning apparatus, scarcely reaches the toner solidifying temperature range. Thus, drive of the first fan may be started after the expiration of the first predetermined time set longer than the time for which the temperature of the thermal fuser rises to the setup temperature of fixing processing.

Thus, drive start of the first fan is delayed from the case where drive of the first fan is started when the temperature of the thermal fuser reaches the setup temperature of fixing processing and the temperature in the apparatus can be made to rise in a shorter time to the temperature at which no condensation occurs on the image support, etc.

By the way, when the temperature in the apparatus just before the power is turned on is comparatively high in summer or because time has not much elapsed since the image formation apparatus was previously powered off, if the first and second fans remain stopped after the power is turned on as described above, it is feared that the temperature on the periphery of the thermal fuser may immediately rise to the toner solidifying temperature or higher.

Then, the image formation apparatus is provided with an intra-apparatus temperature sensor for detecting intra-apparatus temperature in the image formation apparatus and if the intra-apparatus temperature detected by the intra-apparatus temperature sensor is higher than a predetermined temperature, inhibition means inhibits drive control of the drive control means, whereby if the intra-apparatus temperature before the power is turned on is higher than the predetermined temperature, a situation in which the first and second fans are not immediately driven and the temperature on the periphery of the thermal fuser rises to the toner solidifying temperature or higher can be prevented reliably.

If time has not much elapsed since the power was previously turned off, etc., a considerable difference may exist between the intra-apparatus temperature and the temperature of the thermal fuser. Therefore, more preferably, as described in aspect 10, the image formation apparatus is provided with a thermal fuser temperature sensor for detecting temperature of the thermal fuser and an intra-apparatus temperature sensor for detecting intra-apparatus temperature. If the intra-apparatus temperature detected by the intra-apparatus temperature sensor is higher than a first predetermined temperature and the temperature of the thermal fuser detected by the thermal fuser temperature sensor is higher than a second predetermined temperature, inhibition means inhibits drive control of the drive control means.

Thus, both the intra-apparatus temperature and the temperature of the thermal fuser are monitored and if the intra-apparatus temperature before the power is turned on is higher than the first predetermined temperature and the temperature of the thermal fuser is higher than the second predetermined temperature, a situation in which the first and second fans are not immediately driven and the temperature on the periphery of the thermal fuser rises to the toner solidifying temperature or higher can be prevented more reliably.

BRIEF DESCRIPTION OF THE DRAWINGS

In the accompanying drawings:

FIG. 7 is a graph to show change in temperature on the periphery of a photosensitive drum, temperature in a cleaning apparatus, and temperature of a thermal fuser after power is turned on in a fourth embodiment of the invention;

FIG. 8 is a graph to show change in temperature on the periphery of the photosensitive drum, temperature in the cleaning apparatus, temperature of the thermal fuser, and intra-machine temperature when power is again turned on;

FIG. 13 is a drawing to show the structure of a holding part for holding a holder on a housing with rubber like a thin plate between.

DETAILED DESCRIPTION OF THE PREFERRED EMBODIMENTS

First, the general configuration of a color image formation apparatus (color laser beam printer) using an intermediate transfer body incorporating the invention will be discussed.

Figure 1:
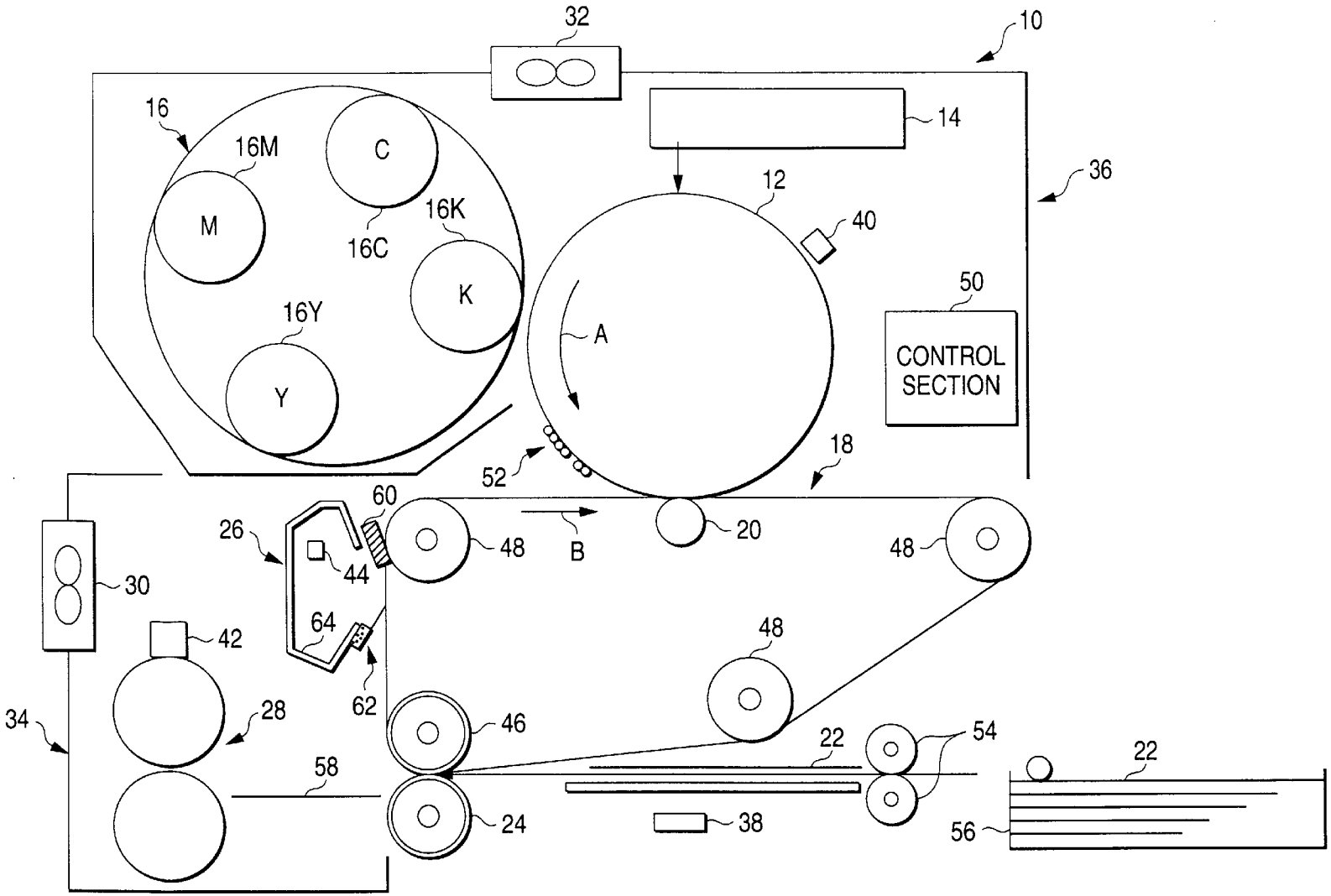
FIG. 1 is a schematic diagram to show the configuration of a color image formation apparatus in one embodiment of the invention.

As shown in FIG. 1, a color image formation apparatus 10 comprises a photosensitive drum 12 rotating in the arrow A direction, an exposure device 14 for applying a light beam for writing a latent image onto the photosensitive drum 12, a rotation developing apparatus 16 for developing a latent image to a toner image, an intermediate transfer belt 18, a transfer roll 20 for primarily transferring the toner image on the photosensitive drum 12 to the intermediate transfer belt 18, a transfer roll 24 for secondarily transferring the toner image on the intermediate transfer belt 18 to recording paper 22, a cleaning apparatus 26 for cleaning residual toner on the intermediate transfer belt 18 after secondary transfer, a thermal fuser 28 for thermally fixing unfixed toner on recording paper 22, a cooling fan 30 for releasing heat generated from the thermal fuser 28 mainly into the outside of the apparatus, a cooling fan 32 for releasing heat generated from the rotary developing apparatus 16, the photosensitive drum 12, and the exposure device 14 mainly into the outside of the apparatus, and a control section 50 made of a microcomputer for controlling and monitoring the operation of the components of the color image formation apparatus 10.

To enhance the exhaust and heat insulation effects, the color image formation apparatus 10 contains a room 34 in which the thermal fuser 28 is housed and a room 36 in which the rotary developing apparatus 16, the photosensitive drum 12, and the exposure device 14 are housed. It also contains an intra-machine temperature sensor 38 for detecting a typical temperature in the apparatus, which will be hereinafter referred to as intra-machine temperature, a photosensitive body temperature sensor 40 for detecting a temperature in the proximity of the photosensitive drum 12, a thermal fuser temperature sensor 42 for detecting a temperature of the thermal fuser 28, and a cleaning apparatus temperature sensor 44 for detecting a temperature in the cleaning apparatus 26. Detection signals of these sensors are input to the control section 50.

The rotary developing apparatus 16 comprises a developing device 16C for developing a cyan (C) toner image, a developing device 16M for developing a magenta (M) toner image, a developing device 16Y for developing a yellow (Y) toner image, and a developing device 16C for developing a black (K) toner image. For example, to develop a toner image corresponding to yellow image data, the rotary developing apparatus 16 rotates, whereby the developing device 16Y approaches the photosensitive drum 12 and performs developing processing for forming a yellow toner image on the photosensitive drum 12.

The intermediate transfer belt 18 is placed on a backup roll 46 and three rolls 48 so as to abut the surface of the photosensitive drum 12 and turns in the arrow B direction. The transfer roll 20 is placed in the abutment portion of the intermediate transfer belt 18 and the photosensitive drum 12. It applies a voltage of the opposite polarity to the charge polarity of a toner image 52 formed on the photosensitive drum 12 to the intermediate transfer belt 18 and electrostatically attracts the toner image 52 from the photosensitive drum 12 to the intermediate transfer belt 18 as primary transfer. Since the toner image on the intermediate transfer belt 18 is not cleaned at the time of the primary transfer, the cleaning apparatus 26 is out of contact with the intermediate transfer belt 18.

On the other hand, at a secondary transfer position, the transfer roll 24 serving as a counter electrode is placed at a position facing the backup roll 46 so that it can come in contact with or out of contact with the intermediate transfer belt 18. After completion of the primary transfer to the intermediate transfer belt 18, a drive (not shown) causes the transfer roll 24 to come in contact with the intermediate transfer belt 18. In this contact state, recording paper 22 transported out from a tray 56 at a predetermined timing by means of a feed roller 54 is sandwiched between the transfer roll 24 and the intermediate transfer belt 18 and is transported, whereby the toner image on the intermediate transfer belt 18 is secondarily transferred to the recording paper 22.

The recording paper 22 to which the image is thus transferred is transported to the thermal fuser 28 along a transport chute 58 and the toner image is fixed by the thermal fuser 28. The cleaning apparatus 26 installed near the thermal user 28 abuts the intermediate transfer belt 18 and cleans residual toner on the intermediate transfer belt 18 after the secondary transfer.

Figure 2:
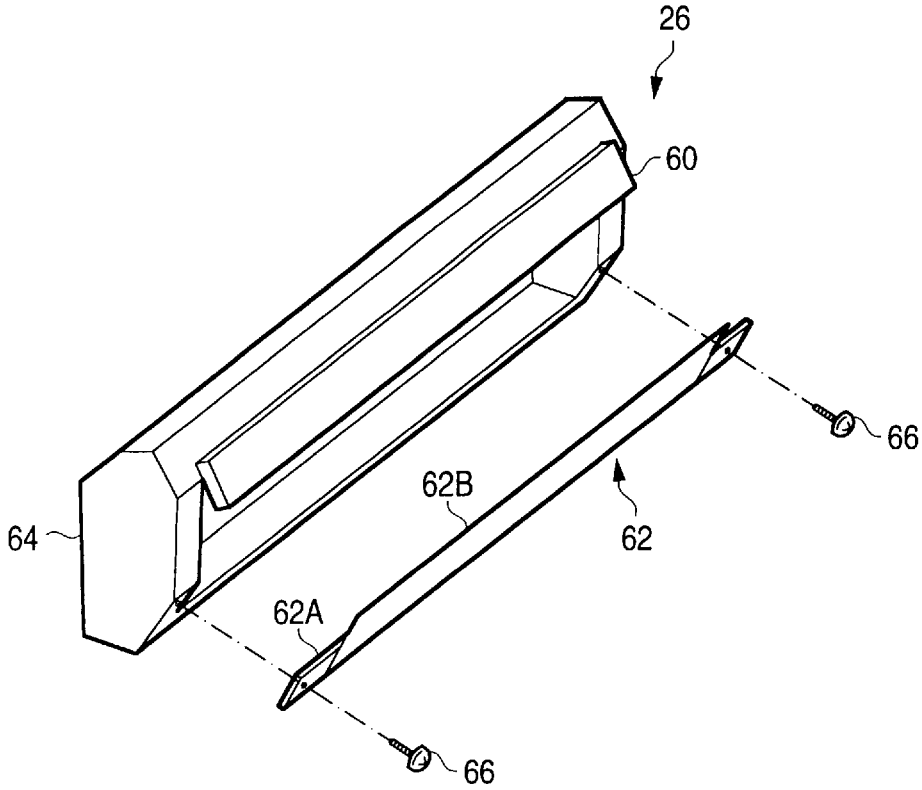
FIG. 2 is a perspective view of a cleaning apparatus.

Next, the configuration of the cleaning apparatus 26 in he embodiment will be discussed. As shown in FIG. 2, the cleaning apparatus 26 comprises a cleaning member 60 for cleaning residual toner on the intermediate transfer belt 18, a guide member 62 for guiding the cleaned toner into the cleaning apparatus 26, and a housing 64 for holding the cleaning member 60 and the guide member 62, the housing 64 being formed with an opening on the intermediate transfer belt 18 side. As shown in FIG. 4, the guide member 62 is made up of a PET film 62B being placed in contact with the surface of the intermediate transfer belt 18 as a guide plate for guiding toner into the cleaning apparatus 26 and a holder 62A for holding the PET film 62B. The holder 62A and the PET film 62B are bonded by double-sided tape 68 (see FIG. 3).

In the embodiment, the housing 64 is formed of a plastic resin material and the holder 62A is formed of a thin metal plate.

Thus, the housing 64 has a larger thermal expansion coefficient than the holder 62A.

Figure 3:
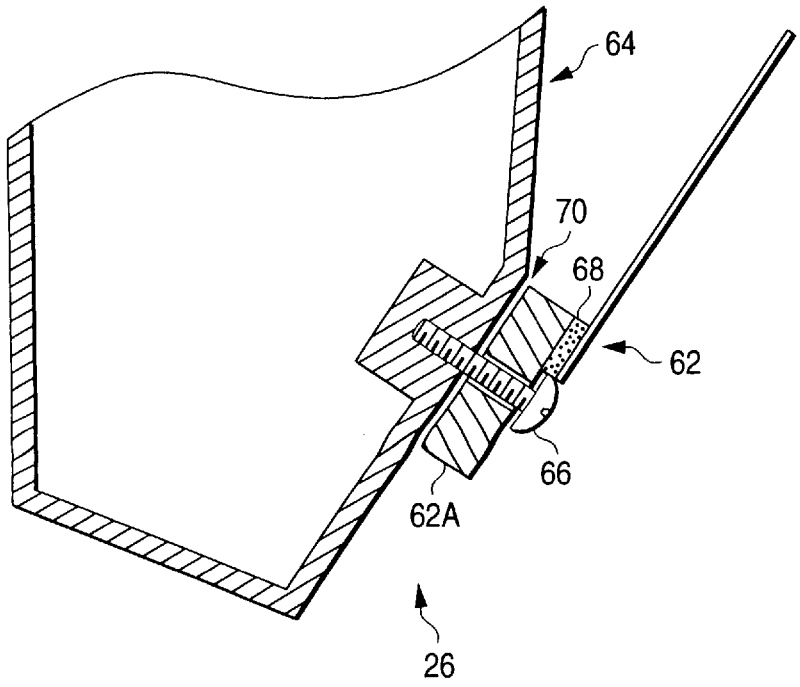
FIG. 3 is a sectional view to show a holding structure of a seal member in a first embodiment of the invention.
Figure 4:
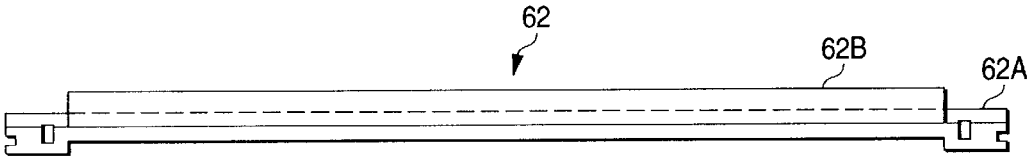
FIG. 4 is a front view of the seal member in FIG. 3.

As shown in FIGS. 2 and 3, the guide member 62 is screwed into the housing 64 by two screws 66 in the vicinity of both ends of the holder 62A in the length direction thereof. Moreover, the screwing is loosened by a predetermined amount intentionally for providing a gap 70 of about 0.03–0.1 mm between the holder 62A and the housing 64.

The gap 70 may be provided by loosening the screws 66 by a predetermined amount intentionally or by screwing the guide member 62 into the housing 64 with a thin plate member sandwiched between the holder 62A and the housing 64 and drawing out the plate member after screwing the guide member 62 into the housing 64.

By the way, heat is generated from the thermal fuser 28 during the operation of the color image formation apparatus 10. At this time, the cooling fan 30 operates, preventing the inside of the room 34 from reaching a high temperature, but the cleaning apparatus 26 is warmed by the heat from the thermal fuser 28 and the housing 64 and the holder 62A are thermally expanded. At this time, the housing 64 has a larger thermal expansion coefficient than the holder 62A as described above, thus a difference occurs between the expansion amounts of the housing 64 and the holder 62A.

In the embodiment, however, the gap 70 is provided between the housing 64 and the holder 62A, so that it absorbs the difference between the expansion amounts of the housing 64 and the holder 62A and a force of warp, distortion, etc., does not act on the holder 62A. Thus, deformation of the PET film 62B held by the holder 62A can be prevented and trouble such as toner cleaned by the cleaning member 60 not being guided into the housing and scatters can be prevented.

Figure 5:
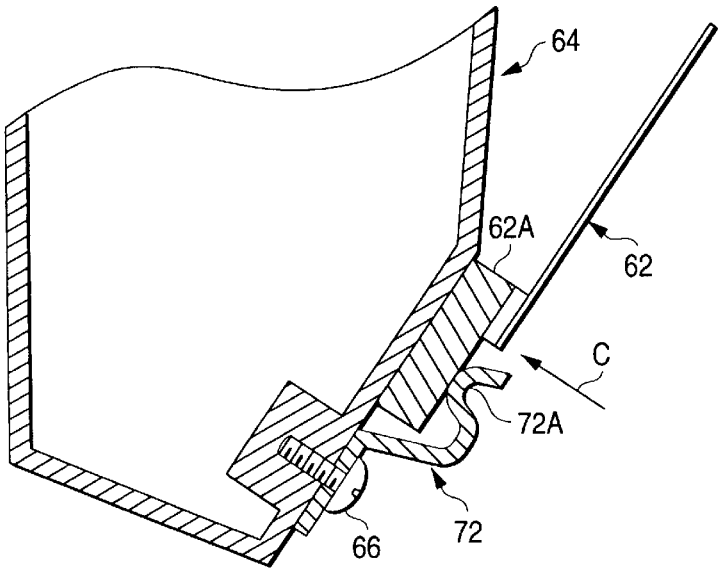
FIG. 5 is a sectional view to show a holding structure of a seal member in a second embodiment of the invention.

Next, a second embodiment of the invention will be discussed. In the second embodiment, as shown in FIG. 5, a plate spring 72 is screwed into a housing 64 by a screw 66 and a holder 62A is sandwiched between a tip part 72A of the plate spring 72 and the housing 64. At this time, the tip part 72A is urged in the arrow C direction and the holder 62A is held on the housing 64 by the urging force.

In a cleaning apparatus 26 having such a configuration, if heat is generated from a thermal fuser 28 during the operation of a color image formation apparatus 10 and the housing 64 and the holder 62A are thermally expanded and a difference occurs between the expansion amounts of the housing 64 and the holder 62A as previously described in the first embodiment, the plate spring 72 absorbs the expansion amount difference and a force of warp, distortion, etc., does not act on the holder 62A. Thus, deformation of a PET film 62B held by the holder 62A can be prevented and trouble such as toner cleaned by a cleaning member 60 not being guided into the housing and scatters can be prevented.

Figure 6:
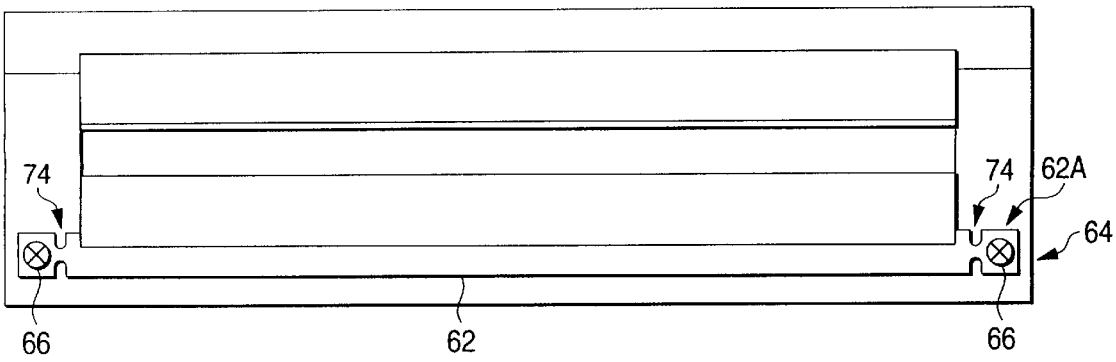
FIG. 6 is a front view of a cleaning apparatus in a third embodiment of the invention.

Next, a third embodiment of the invention will be discussed. In the third embodiment, as shown in FIG. 6, a guide member 62 is secured to a housing 64 by screws 66 in the vicinity of both ends of a holder 62A. The holder 62A in the third embodiment is formed with a part made extremely narrow and low in rigidity (low-rigidity part) 74 in the vicinity of each of the two secured parts to the housing 64.

In a cleaning apparatus 26 having such a configuration, if heat is generated from a thermal fuser 28 during the operation of a color image formation apparatus 10 and the housing 64 and the holder 62A are thermally expanded and a difference occurs between the expansion amounts of the housing 64 and the holder 62A as previously described in the first embodiment, the low-rigidity parts 74 absorb the expansion amount difference and a force of warp, distortion, etc., does not act on the holder 62A. Thus, deformation of a PET film 62B held by the holder 62A can be prevented and trouble such as toner cleaned by a cleaning member 60 not being guided into the housing and scatters can be prevented.

Figure 13:
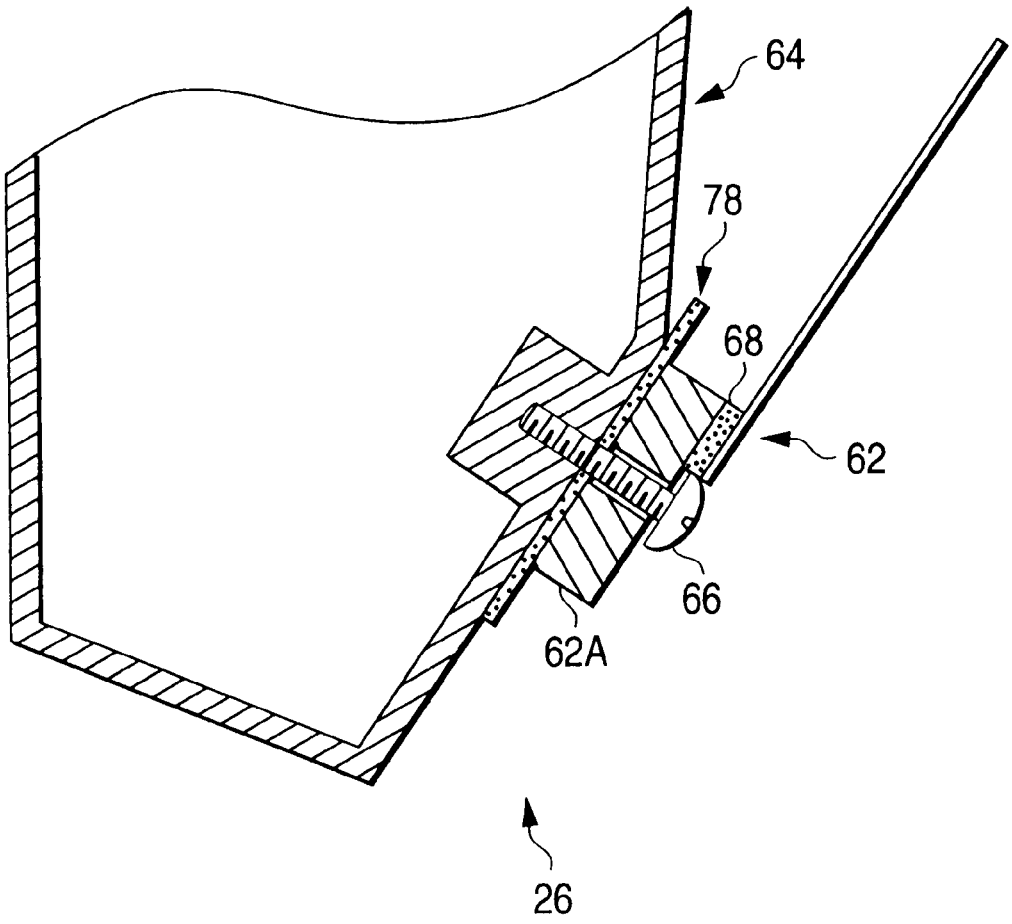

In addition to the first to third embodiments, a holder 62A may be held on a housing 64 with rubber 78 like a thin plate between, as shown in FIG. 13. Also in this case, if the housing 64 and the holder 62A are thermally expanded due to heat from a thermal fuser 28 and a difference occurs between the expansion amounts of the housing 64 and the holder 62A, the expansion amount difference is absorbed because of elastic deformation of the rubber 78. Thus, deformation of a PET film 62B can be prevented and trouble such as toner cleaned by a cleaning member 60 guided into the housing 64 and scatters can be prevented.

The guide member 62 may be formed so that the holder 62A roughly equals the housing 64 in thermal expansion coefficient. In this case, if heat is generated from the thermal fuser 28 during the operation of the color image formation apparatus 10 and the housing 64 and the holder 62A are thermally expanded, a difference does not occur between the expansion amounts of the housing 64 and the holder 62A. Therefore, a force of warp, distortion, etc., does not act on the holder 62A, deformation of the PET film 62B can be prevented, and trouble such toner cleaned by the cleaning member 60 not being guided into the housing 64 and scatters can be prevented.

The guide member 62 may be formed so that the holder 62A has by far higher rigidity than the housing 64. For example, the holder 62A is formed of thick hard plastic, solid metal, etc., whereby it can be provided with by far higher rigidity than that of the housing 64 formed of a plastic resin material. In this case, if heat is generated from the thermal fuser 28 during the operation of the color image formation apparatus 10 and the housing 64 and the holder 62A are thermally expanded and a difference occurs between the expansion amounts of the housing 64 and the holder 62A as described above, causing a force to act on the holder 62A, the holder 62A becomes little deformed because it has extremely high rigidity. Therefore, deformation of the PET film 62B can be prevented and trouble such that toner cleaned by the cleaning member 60 is not guided into the housing 64 and scatters can be prevented.

Next, a fourth embodiment of the invention will be discussed. In the fourth embodiment, after power of a color image formation apparatus 10 is turned on, a control section 50 controls driving of cooling fans 30 and 32 so that condensation on a photosensitive drum 12, an exposure device 14, and a developing apparatus 16 can be prevented while toner is prevented from being solidified in a cleaning apparatus 26.

Figure 10:
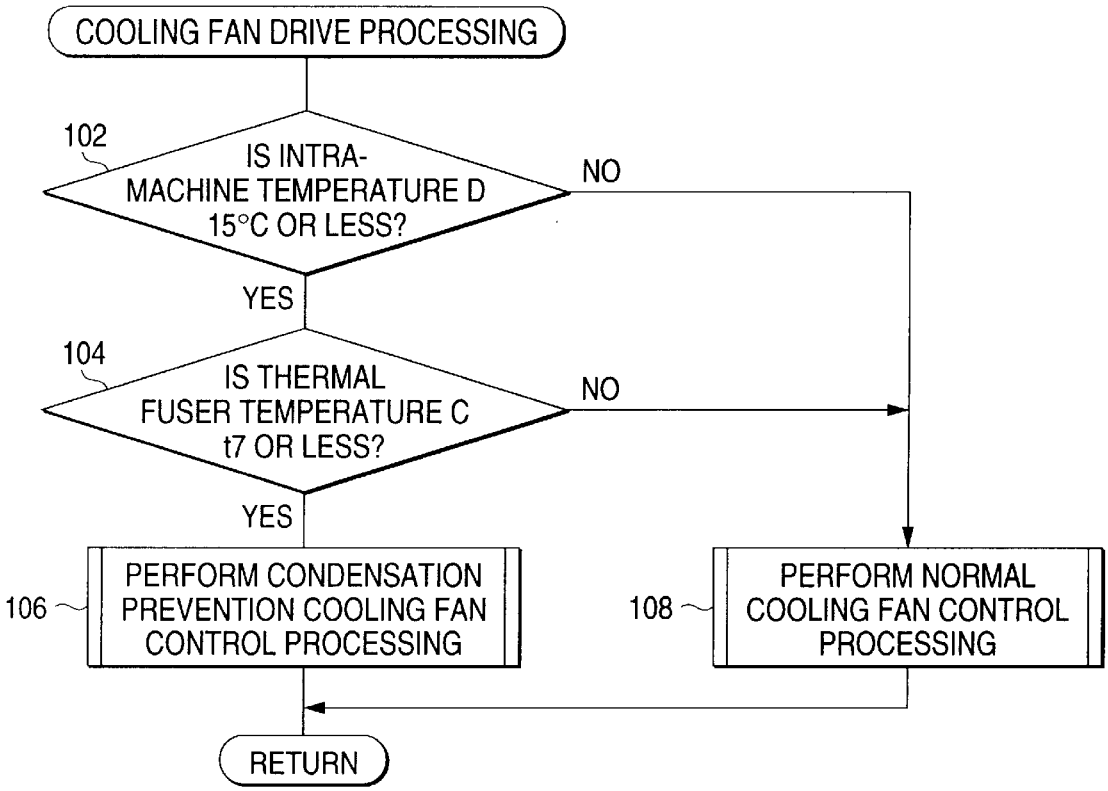
FIG. 10 is a flowchart to show a control routine of cooling fan drive processing in the fourth embodiment of the invention.

When power of the color image formation apparatus 10 shown in FIG. 1 is turned on, the control section 50 starts execution of cooling fan drive processing in FIG. 10. At step 102 in FIG. 10, whether or not the intra-machine temperature detected by an intra-machine temperature sensor 38 (intra-machine temperature D) is 15° C. or less is determined. The temperature 15° C. is preset as the lower limit value in the temperature range in which condensation on the photosensitive drum 12, the exposure device 14, and the developing apparatus 16 can be prevented reliably.

If the intra-machine temperature D is higher than 15° C., it can be judged that condensation on the photosensitive drum 12, the exposure device 14, and the developing apparatus 16 does not occur. Then, control goes to step 108 and normal cooling fan control processing described later (FIG. 11) is performed.

Figure 9:
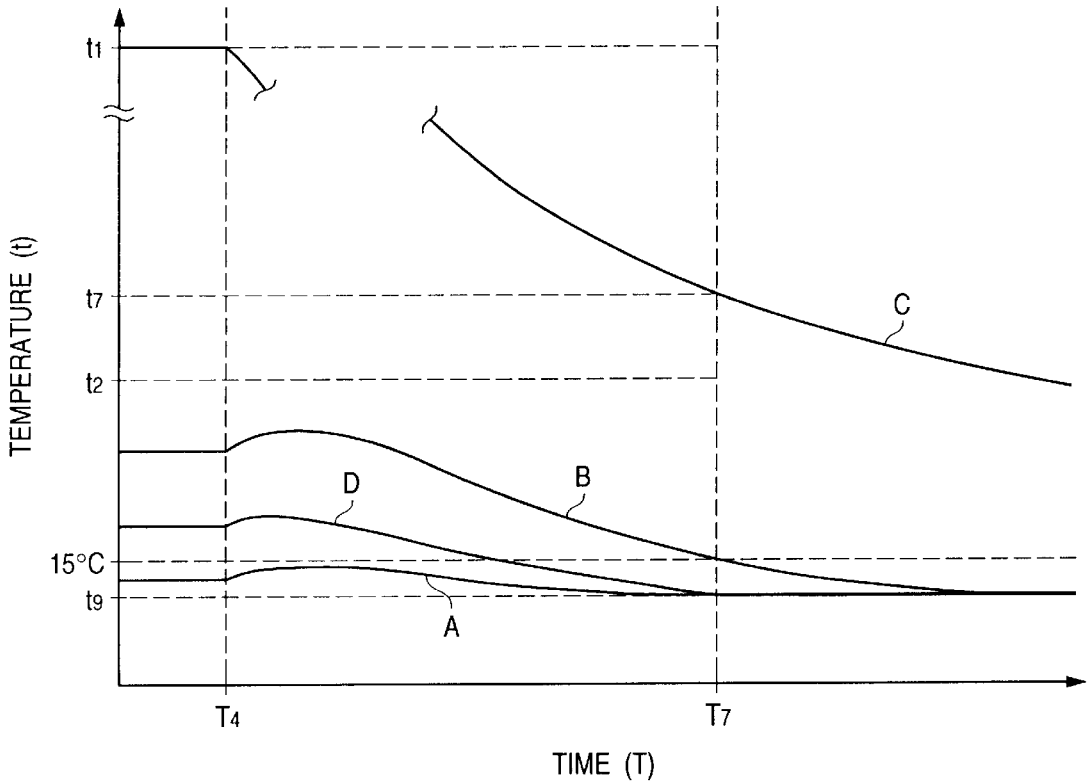
FIG. 9 is a graph to show change in temperature on the periphery of the photosensitive drum, temperature in the cleaning apparatus, temperature of the thermal fuser, and intra-machine temperature after power is turned off.

On the other hand, if the intra-machine temperature D is 15° C. or less at step 102, control goes to step 104 and whether or not the temperature of a thermal fuser 28 detected by a thermal fuser temperature sensor 42 (thermal fuser temperature C) is a predetermined temperature t7 or less. The predetermined temperature t7 is preset as a value of the thermal fuser temperature C applied when the machine inside is sufficiently cooled in a power off state, namely, when the intra-machine temperature D shown in FIG. 9 becomes stable (time T7).

If the thermal fuser temperature C is higher the temperature t7, control goes to step 108 and normal cooling fan control processing described later (FIG. 11) is performed. If the thermal fuser temperature C is the temperature t7 or less, control goes to step 106 and condensation prevention cooling fan control processing described later (FIG. 12) is performed. That is, the condensation prevention cooling fan control processing at step 106 (FIG. 12) is performed only if the intra-machine temperature D is 15° C. or less and the thermal fuser temperature C is the temperature t7 or less.

Figure 11:
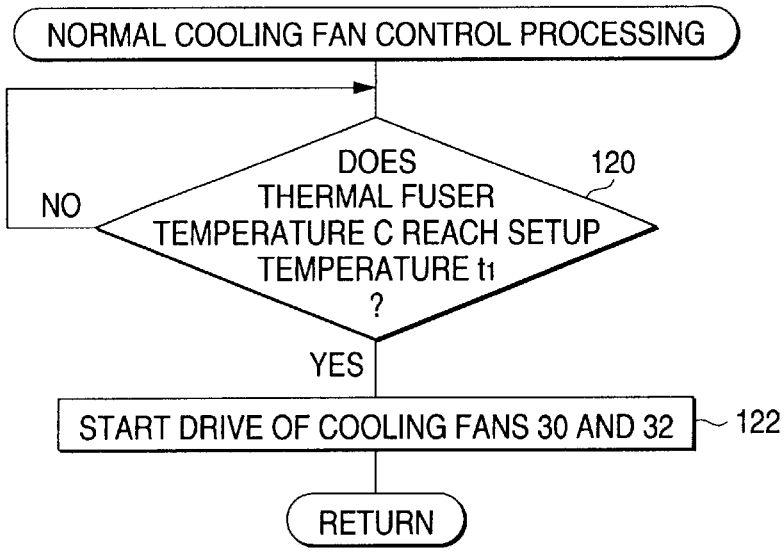
FIG. 11 is a flowchart to show a subroutine of normal cooling fan control processing.

If the intra-machine temperature D is higher than 15° C. or the thermal fuser temperature C is higher than the temperature t7, there is no fear of occurrence of condensation on the photosensitive drum 12, the exposure device 14, or the developing apparatus 16, but the cleaning apparatus 26 is not sufficiently cooled and it is feared that toner in the cleaning apparatus 26 may be solidified. Thus, the control section 50 performs the normal cooling fan control processing (FIG. 11).

That is, after the power is turned on, the color image formation apparatus 10 is warmed up, but the cooling fans 30 and 32 remain stopped. Thus, the rooms 34 and 36 are warmed quickly by heat generated from the components of the thermal fuser 28, etc. When the thermal fuser temperature C reaches a setup temperature t1 fitted to thermal fixing processing, namely, YES is returned from step 120 in FIG. 11, driving of the cooling fans 30 and 32 is started at the same time at step 122, whereby heat is quickly released from the rooms 34 and 36 and rises in the thermal fuser temperature C and the intra-machine temperature D can be suppressed, avoiding a situation in which the thermal fuser 28 is overheated and toner in the cleaning apparatus 26 placed near the thermal fuser 28 is solidified.

Figure 12:
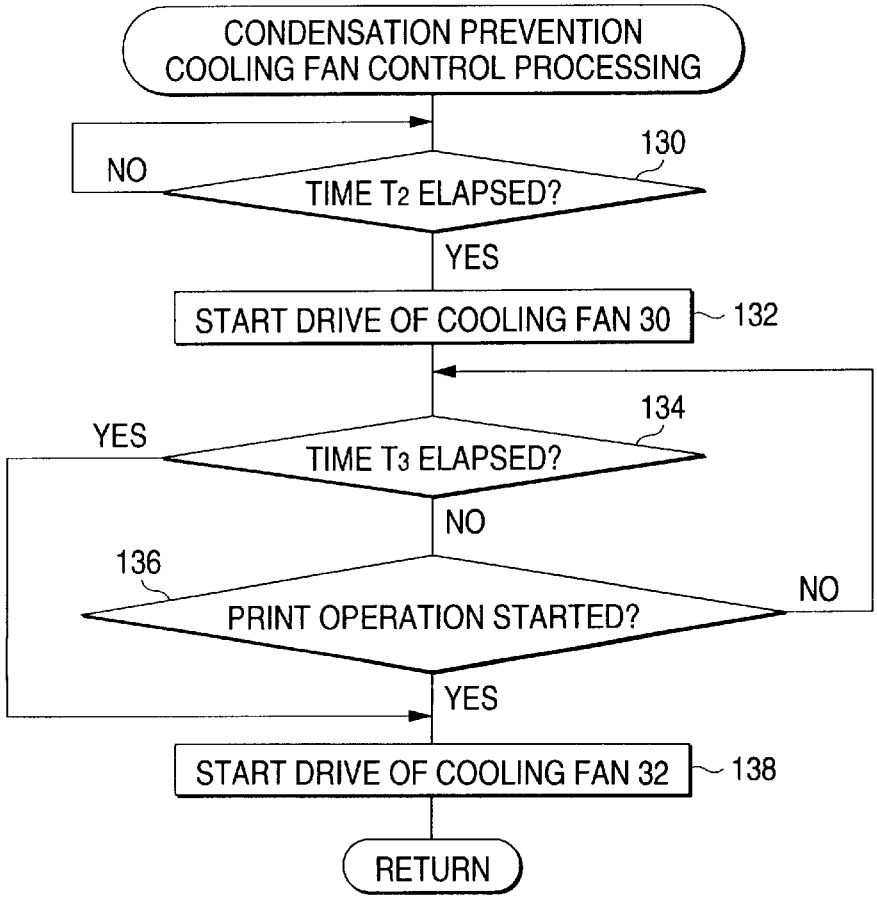
FIG. 12 is a flowchart to show a subroutine of condensation prevention cooling fan control processing.

On the other hand, if the intra-machine temperature D is 15° C. or less and the thermal fuser temperature C is the temperature t7 or less, there is a fear of occurrence of condensation on the photosensitive drum 12, the exposure device 14, and the developing apparatus 16. Thus, the control section 50 performs the condensation prevention cooling fan control processing (FIG. 12).

That is, after the power is turned on, the color image formation apparatus 10 is warmed up, but the cooling fans 30 and 32 remain stopped. Thus, outside air does not enter the periphery of the photosensitive drum 12 and no condensation occurs. Heat from the-thermal fuser 28 also propagates to the periphery of the photosensitive drum 12 and temperature A (FIG. 7) in the proximity of the photosensitive drum 12 detected by a photosensitive body temperature sensor 40 rises quickly and reaches in a short time a boundary temperature t3 at which no condensation occurs on the photosensitive drum 12, etc., if outside air flows therein. Thus, condensation can be reliably prevented from occurring on the photosensitive drum 12 or the exposure device 14 or the developing apparatus 16 on the periphery of the photosensitive drum 12.

When a predetermined time T2 (FIG. 7) has elapsed since the power was turned on (when YES is returned from step 130 in FIG. 12), drive of only the cooling fan 30 is started at step 132. As seen in FIG. 7, the time T2 is preset as the time until a temperature B of the cleaning apparatus 26 detected by a cleaning apparatus temperature sensor 44 reaches a slightly lower level than a lower limit value t2 in the toner solidifying temperature range.

Thus, heat is released from the room 34 into the outside of the apparatus by the cooling fan 30 and as shown in FIG. 7, a rise in the temperature B of the cleaning apparatus 26 is suppressed and the temperature B does not reach the toner solidifying temperature range and becomes stable as the temperature t2 or less. Therefore, a situation in which toner in the cleaning apparatus 26 is solidified can be avoided.

As the cooling fan 30 is operated, a rise in the temperature A in the proximity of the photosensitive drum 12 becomes moderate. After this, only the cooling fan 30 is operated until the expiration of a time T3 since turning on the power or until print operation is started. The time T3 is preset as the time until the temperature A in the proximity of the photosensitive drum 12 becomes higher than an outside air temperature t4 reliably.

When the time T3 has elapsed or the print operation is started, drive of the cooling fan 32 is started at step 138. FIG. 7 shows an example wherein drive of the cooling fan 32 is started after the expiration of the time T3. As the cooling fan 32 is operated, heat in the room 36 is released and a rise in the temperature A in the proximity of the photosensitive drum 12 is suppressed and the temperature A becomes stable in the proximity of the outside air temperature t4.

According to the invention, the periphery of the photosensitive drum 12 is effectively warmed using the heat from the thermal fuser 28 just after the power is turned on, whereby the temperature A in the proximity of the photosensitive drum 12 can be made in a short time to the boundary temperature t3 at which no condensation occurs on the photosensitive drum 12, etc., and condensation can be reliably prevented from occurring on the photosensitive drum 12 or the exposure device 14 or the developing apparatus 16 on the periphery of the photosensitive drum 12.

When the predetermined time T2 has elapsed since the power was turned on, drive of only the cooling fan 30 is started. Thus, heat is released from the room 34 for making the temperature B of the cleaning apparatus 26 stable at the temperature t2 or less, and a situation in which toner in the cleaning apparatus 26 is solidified can be avoided.

Time T1 at which the thermal fuser temperature C reaches a setup temperature t1 may be adopted as the timing at which drive of only the cooling fan 30 is started. At this time, a temperature A' in the proximity of the photosensitive drum 12 and a temperature B' of the cleaning apparatus 26 run as indicated by dashed lines in FIG. 7, for example.

In this case, rises in the temperatures A' and B' after the time T1 become a little moderate, thus the time until the temperature A' reaches the temperature t3 at which no condensation occurs on the photosensitive drum 12, etc., is prolonged a little. However, the temperature B' does not approach the toner solidifying temperature range and the situation in which toner in the cleaning apparatus 26 is solidified can be avoided more reliably.

By the way, if the power of the color image formation apparatus 10 is turned off after the inside is sufficiently warmed after the expiration of time T4 since the power was turned on, as shown in FIG. 8, the thermal fuser temperature C and the temperature B of the cleaning apparatus 26 near the thermal fuser 28 do not lower readily because the thermal fuser 28 has a large heat capacity. On the other hand, components having a large heat capacity do not exist on the periphery of the intra-machine temperature sensor 38 or the photosensitive drum 12 and thus the temperature lowers rapidly.

If the power of the color image formation apparatus 10 is again turned on at time T5 at which the intra-machine temperature D detected by the intra-machine temperature sensor 38 becomes 15° C., the temperature B of the cleaning apparatus 26 starts to rise at t5.

If execution of the condensation prevention cooling fan control processing (FIG. 12) is started at the time T5, the temperature B arrives at the toner solidifying temperature range as indicated by the solid line in FIG. 8 because drive of the cooling fan 30 is not started between the instant at which the power is again turned on and the time T2; toner cannot be prevented from being solidified in the cleaning apparatus 26.

In the invention, the thermal fuser temperature C at the time T5 is still at a high level and is higher than the above-mentioned temperature t7, thus the normal cooling fan control processing is performed at step 108 in FIG. 10. That is, drive of the cooling fans 30 and 32 is started at the time T1 at which the thermal fuser temperature C reaches the setup temperature t1, and a situation in which the temperature B' exceeds the temperature t2 is avoided, as indicated by the dashed line in FIG. 8. That is, when the power of the color image formation apparatus 10 is again turned on, toner can also be prevented from being solidified in the cleaning apparatus 26.

In the invention, the condensation prevention cooling fan control processing (FIG. 12) is performed only if the intra-machine temperature D is 15° C. or less and the thermal fuser temperature C is the temperature t7 or less. However, if the inside of the color image formation apparatus 10 is not partitioned as the rooms 34, 36, etc., the intra-machine temperature D and the thermal fuser temperature C change in a similar fashion. Thus, only the intra-machine temperature D may be monitored so that the condensation prevention cooling fan control processing is performed only if the intra-machine temperature D is a predetermined time or less.

In the invention, the color image formation apparatus contains the four sensors of the intra-machine temperature sensor 38, the photosensitive body temperature sensor 40, the thermal fuser temperature sensor 42, and the cleaning apparatus temperature sensor 44. However, to execute the control routines in FIGS. 10 to 12, the intra-machine temperature sensor 38 and the thermal fuser temperature sensor 42 need only to be provided.

The intra-machine temperature sensor 38 is an indispensable component for controlling image formation conditions of exposure condition, developing bias voltage, developing dispense amount, etc., and the thermal fuser temperature sensor 42 is an indispensable component for maintaining the thermal fuser temperature C at the setup temperature t1; they are installed in a general image formation apparatus. Special hardware is not required for executing the cooling fan drive processing in the embodiment. Thus, an increase in costs is not involved in execution of the cooling fan drive processing in the embodiment.

In the description, the color image formation apparatuses have been discussed, but the invention can be applied to single-color image formation apparatuses, needless to say. For the single-color image formation apparatuses, a photosensitive drum, a photosensitive belt, etc., on which a single-color toner image is formed can be adopted as an image support, and the invention is applied to a cleaning apparatus placed in the proximity of the photosensitive drum, a photosensitive belt, etc.

As described above, according to the invention the holding plate makes a relative move to the housing in response to the terminal expansion amount difference, thus warp or distortion of the holding plate and deformation of the seal member can be prevented and trouble such that the toner cleaned by the cleaning member is not guided into the housing and scatters can be prevented.

According to the invention after the expiration of the first predetermined time since the power was turned on, only the first fan is driven and later when the second predetermined time has elapsed or when the first image formation operation is started, the second fan is driven. Thus, while a situation in which the temperature on the periphery of the thermal fuser rises to the toner solidifying temperature or more is avoided, the temperature in the apparatus can be made to rise in a short time to the temperature at which no condensation occurs on the image support, etc.

What is claimed is:

1. A cleaning apparatus being placed in the proximity of a surface of an image support with a toner image formed on the surface, said cleaning apparatus comprising:

a cleaning member for cleaning residual toner on said image support;

a housing having an opening formed toward said image support; and a holding plate fastened at two ends there of so as to be able to make a relative move to said housing in a predetermined range for holding a seal member for guiding toner cleaned by said cleaning member into said housing.

2. A cleaning apparatus being placed in the proximity of a surface of an image support with a toner image formed on the surface, said cleaning apparatus comprising:

a cleaning member for cleaning residual toner on said image support;

a housing having an opening formed toward said image support; and a holding plate being formed of a material different from said housing in thermal expansion coefficient and installed so as to be able to make a relative move to said housing in a predetermined range for holding a seal member for guiding toner cleaned by said cleaning member into said housing.

3. The cleaning apparatus as claimed in claim 2, wherein said holding plate is spaced from said housing with a predetermined gap.

4. The cleaning apparatus as claimed in claim 2, wherein said holding plate is held on said housing by an urging force of an elastic member.

5. The cleaning apparatus as claimed in claim 2, wherein said holding plate is held on said housing with an elastic member therebetween.

6. The cleaning apparatus as claimed in claim 2, wherein said holding plate is held on said housing and is formed with a low-rigidity part on the periphery of the holding part.

* * * * *